US011690409B2

(12) United States Patent
Li

(10) Patent No.: US 11,690,409 B2
(45) **Date of Patent: *Jul. 4, 2023**

(54) BODY-SHAPING CORSET

(71) Applicant: Guangdong Rebitch Product Design Co., Ltd., Guangdong (CN)

(72) Inventor: Sinuo Li, Guangdong (CN)

(73) Assignee: Guangdong Rebitch Product Design Co., Ltd., Shenzhen (CN)

( * ) Notice: Subject to any disclaimer, the term of this patent is extended or adjusted under 35 U.S.C. 154(b) by 116 days.

This patent is subject to a terminal disclaimer.

(21) Appl. No.: 17/240,990

(22) Filed: Apr. 26, 2021

(65) Prior Publication Data

US 2022/0330624 A1 Oct. 20, 2022

(30) Foreign Application Priority Data

Apr. 14, 2021 (CN) ..... 202120758531.2

(51) Int. Cl.
*A41C 1/02* (2006.01)

(52) U.S. Cl.
CPC ..... *A41C 1/02* (2013.01)

(58) Field of Classification Search
CPC ..... A41C 1/02
See application file for complete search history.

(56) References Cited

U.S. PATENT DOCUMENTS

| | | | | | |
|---|---|---|---|---|---|
| 1,555,545 | A * | 9/1925 | Bailey | A41C 1/06 | 450/17 |
| 1,585,298 | A * | 5/1926 | McDonald | A41C 1/06 | 450/10 |
| 2,031,022 | A * | 2/1936 | Wipperman | A41C 1/06 | 450/27 |
| 2,387,552 | A * | 10/1945 | Alberts | A41C 1/06 | 260/665 R |
| 2,388,525 | A * | 11/1945 | Cohen | A41C 1/06 | 450/131 |
| 2,593,832 | A * | 4/1952 | Barcley | A41C 1/06 | 450/24 |
| D577,877 | S * | 10/2008 | Saincome-Vawter | D2/706 | |
| 2006/0276103 | A1* | 12/2006 | Teng | A41C 1/06 | 450/10 |
| 2015/0245670 | A1* | 9/2015 | Angelino | A41C 3/06 | 450/143 |
| 2016/0021937 | A1* | 1/2016 | Cavosie | A41C 3/08 | 450/14 |

* cited by examiner

*Primary Examiner* — Gloria M Hale

(57) ABSTRACT

A body-shaping corset includes: a left-front portion, a right-front portion, a left accessory breast receiving portion, a right accessory breast receiving portion, an upper back portion, and a lower back portion. One side of the lower back portion is connected to one side of the left-front portion, and another side of the lower back portion is connected to one side of the right-front portion. The left-front portion is provided at one side thereof away from the lower back portion with multiple rows of loops, and the right-front portion is provided at one side thereof away from the lower back portion with hooks, the hooks and the multiple rows of loops being connected to each other by hooking. The left-front portion, the right-front portion, the left accessory breast receiving portion, and the right accessory breast receiving portion form a U-shaped neckline.

6 Claims, 5 Drawing Sheets

BODY-SHAPING CORSET

CROSS REFERENCE TO RELATED APPLICATIONS

The present application claims the benefit of Chinese Patent Application No. 202120758531.2 filed on Apr. 14, 2021, the contents of which are incorporated herein by reference in their entirety.

FIELD OF THE INVENTION

The present disclosure relates to a body shaper, and in particular, to a body-shaping corset.

BACKGROUND OF THE INVENTION

With the advancement of society and improvements of economic incomes and living standards, more and more people start to pay attention to management of their own body shape. It is a nature of a female to pursue beauty, and currently more and more females start to use methods such as body shaper, surgery, and exercise to achieve a better body shape. At present, popular ways of body shaping include: body shaper, Pilates, yoga, liposuction, fitness exercise, and the like, and most females hope that they have a body shape as perfect as possible. Accordingly, losing weight and body shaping are first choices of most females currently. Wearing a body shaper is a most convenient and easiest one among these body-shaping methods, and thus is accepted and favored by most females. Among all body shapers, the body-shaping corset containing rubber as a component has the best effect. More and more females tend to use an elastic body-shaping corset. However, body-shaping corsets currently available in the market have limitations in their materials, and therefore when one wears a body-shaping corset, a lot of fat still gathers around the waist, and the curve at the waist is not smooth. When one wears and uses a body-shaping corset currently available in the market, since an upper portion of the body-shaping corset provides an overly strong tightening force, there is a great difference between fat density at the back and fat density at a position where the body-shaping corset is used, so that fat gathering at the back is caused. Seen from the aesthetic aspect, this results in a less perfect body shape instead for a female. This is especially true when a female wears a body shaper but has bumps of fat on the back. Seen from the health aspect, fat gathering affects lymphatic circulation, results in accumulation of toxins, leads to formation of acquired cellulite on the back, thereby influencing the health. Therefore, it is desirable to provide a body-shaping corset which has a better body-shaping effect, is comfortable to wear, does not lead to formation of acquired cellulite on the back, and makes up an imperfection in the body shape of a female.

SUMMARY OF THE INVENTION

In order to solve the above problems, the present disclosure provides a body-shaping corset.

The body-shaping corset includes: a left-front portion, a right-front portion, a left accessory breast receiving portion, a right accessory breast receiving portion, an upper back portion, and a lower back portion. One side of the lower back portion is connected to one side of the left-front portion, and another side of the lower back portion is connected to one side of the right-front portion. The left-front portion is provided at one side thereof away from the lower back portion with multiple rows of loops, and the right-front portion is provided at one side thereof away from the lower back portion with hooks, the hooks and the multiple rows of loops being connected to each other by hooking. A lower end of the upper back portion is connected to an upper end of the lower back portion. One side of the upper back portion is connected to one side of the left accessory breast receiving portion, and another side of the upper back portion is connected to one side of the right accessory breast receiving portion. A lower end of the left accessory breast receiving portion is connected to an upper end of the left-front portion, and a lower end of the right accessory breast receiving portion is connected to an upper end of the right-front portion. The left-front portion, the right-front portion, the left accessory breast receiving portion, and the right accessory breast receiving portion are connected and form a U-shaped neckline.

Further, the body-shaping corset includes an edge covering, which is connected by seaming to outer edges of the left-front portion, the left accessory breast receiving portion, the upper back portion, the right accessory breast receiving portion, the right-front portion, and the lower back portion.

Further, upper ends of the left accessory breast receiving portion, the right accessory breast receiving portion, and the upper back portion are flush with another.

Further, the body-shaping corset is provided therein with a plurality of air-permeable through holes for air permeation.

Further, the body-shaping corset further includes multiple supporting steel ribs, which are disposed along a longitudinal direction of the body-shaping corset.

Further, the left-front portion, the right-front portion, the upper back portion, the lower back portion, the left accessory breast receiving portion, and the right accessory breast receiving portion are formed integrally.

The body-shaping corset provided in the present disclosure has the following beneficial technical effects.

The body-shaping corset in the present disclosure has a simple structural design, is convenient to wear, and has accessory breast receiving and back shaping functions, and thus can meet a need of upper body shaping of females.

BRIEF DESCRIPTION OF THE DRAWINGS

In order to better describe embodiments of the present disclosure or technical solutions in existing technologies, drawings required in describing the embodiments and the existing technologies will be described briefly below. Obviously, drawings described below are only drawings of some embodiments of the present disclosure, and those of ordinary skill in the art can also obtain other drawings based on these drawings without making any creative effort.

DETAILED DESCRIPTION OF THE EMBODIMENTS

Figure 1:
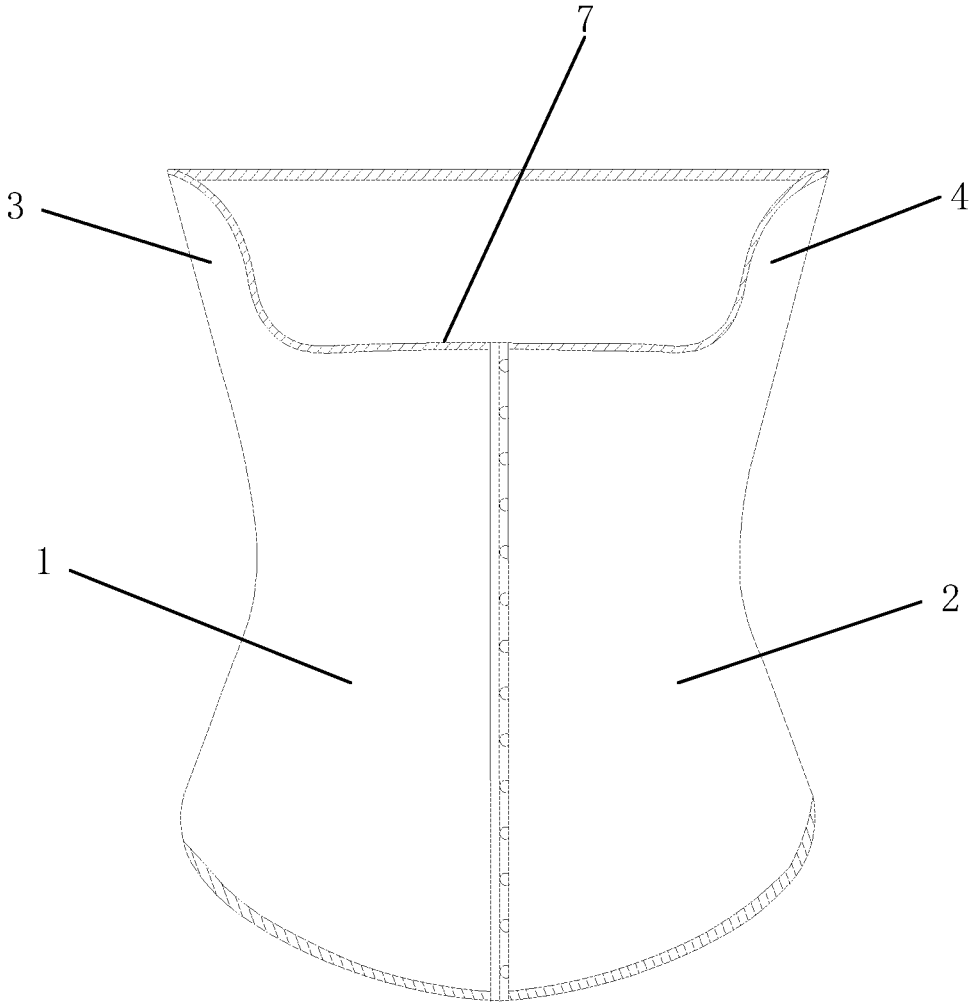
FIG. 1 is a first schematic diagram of a structure of a body-shaping corset in the present disclosure.
Figure 2:
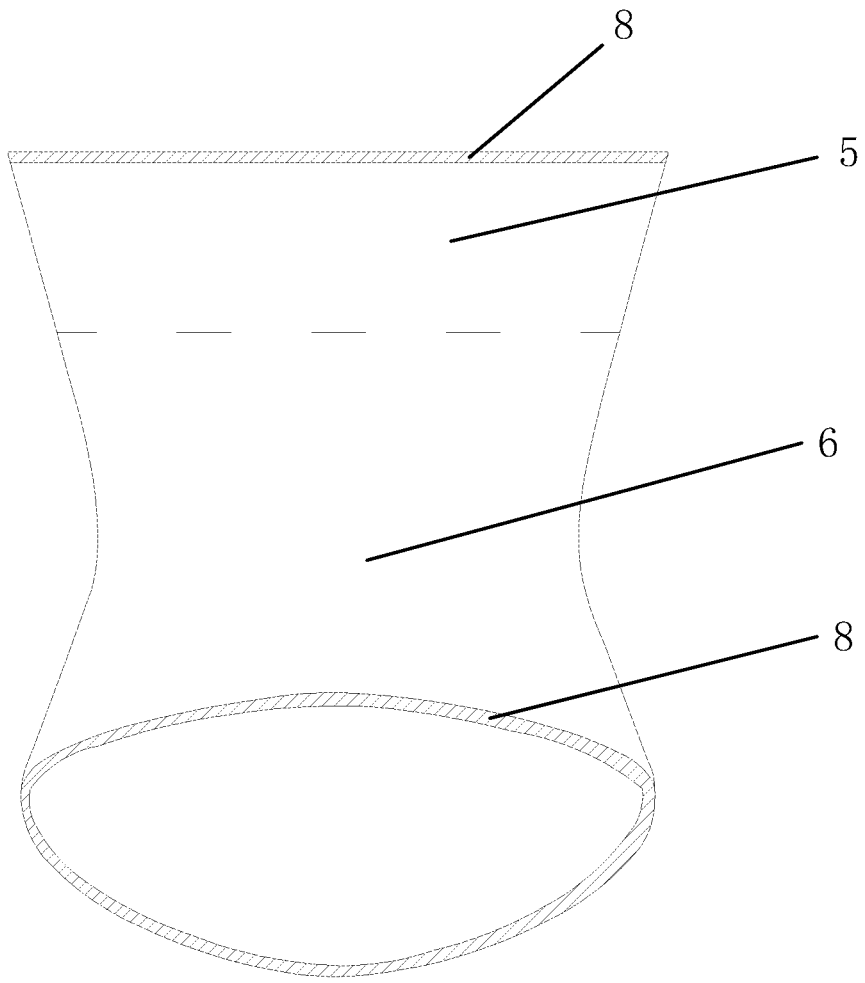
FIG. 2 is a second schematic diagram of the structure of the body-shaping corset in the present disclosure.
Figure 3:
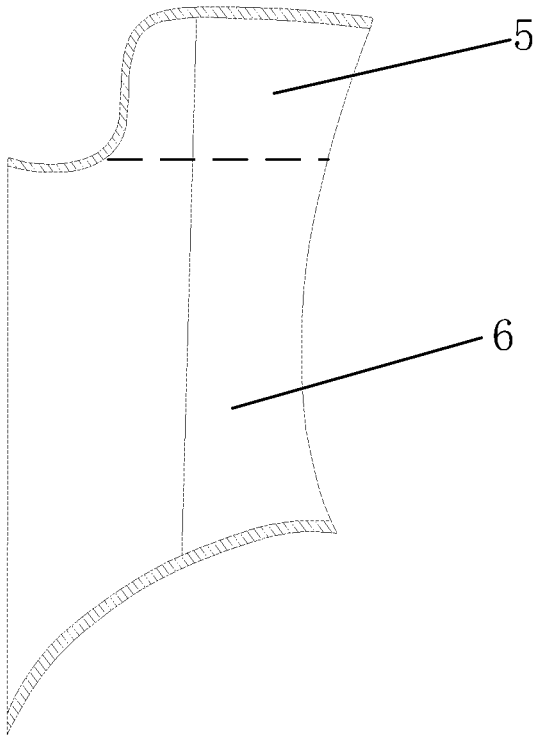
FIG. 3 is a third schematic diagram of the structure of the body-shaping corset in the present disclosure.
Figure 4:
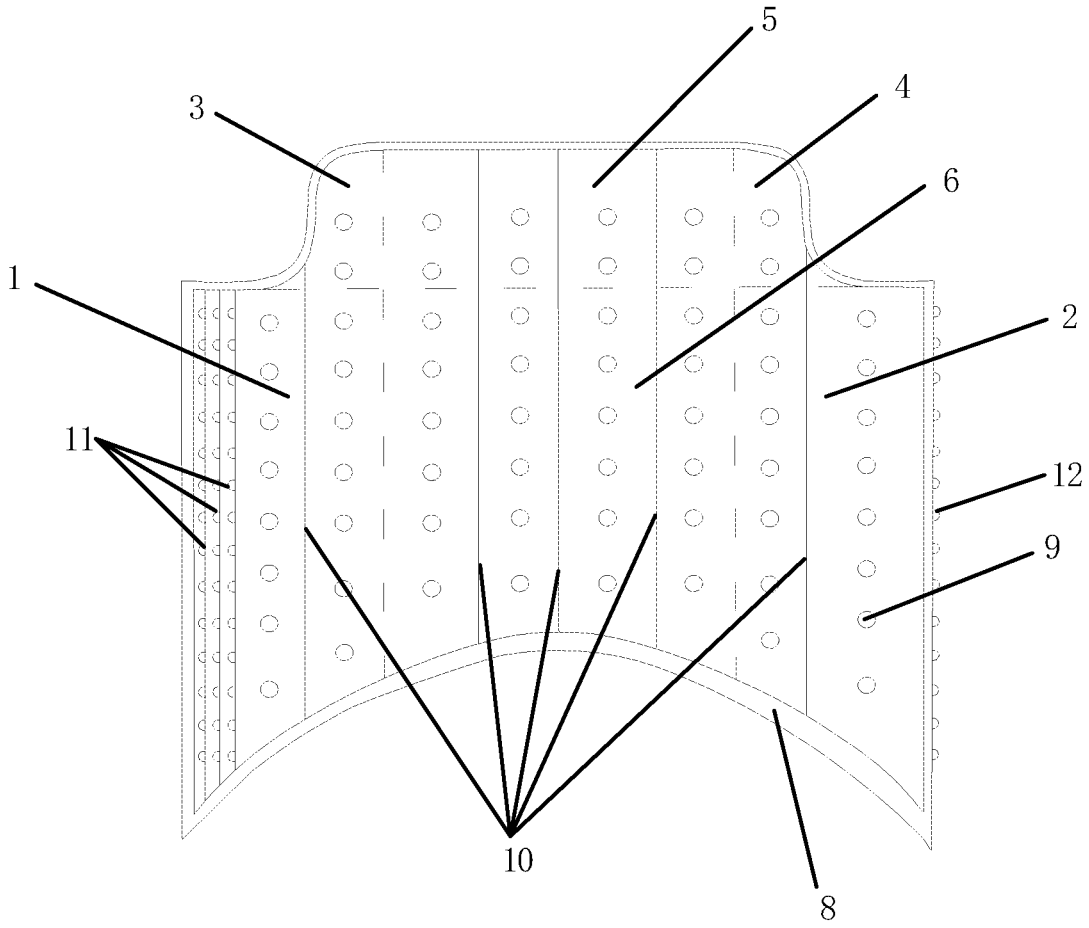
FIG. 4 is a schematic diagram of the body-shaping corset in the present disclosure in an unfolded state.

Technical solutions in embodiments of the present disclosure will be described clearly and completely with reference to the accompanying drawings in the embodiments. Obviously, the embodiments described are only some embodiments, rather than all embodiments, of the present disclosure. All other embodiments obtained by those of ordinary skill in the art based on the embodiments of the present disclosure without making any creative effort fall into the protection scope of the present disclosure.

Referring to FIGS. 1 to 4, a body-shaping corset in embodiments of the present disclosure includes a left-front portion 1, a right-front portion 2, a left accessory breast receiving portion 3, a right accessory breast receiving portion 4, an upper back portion 5, and a lower back portion 6. One side of the lower back portion 6 is connected to one side of the left-front portion 1, and another side of the lower back portion 6 is connected to one side of the right-front portion 2. The left-front portion 1 is provided at one side thereof away from the lower back portion 6 with multiple rows of loops 11, and the right-front portion 2 is provided at one side thereof away from the lower back portion 6 with hooks 12. The hooks 12 and the multiple rows of loops 11 are adjustably connected to each other. A lower end of the upper back portion 5 is connected to an upper end of the lower back portion 6. One side of the upper back portion 5 is connected to one side of the left accessory breast receiving portion 3, and another side of the upper back portion 5 is connected to one side of the right accessory breast receiving portion 4. A lower end of the left accessory breast receiving portion 3 is connected to an upper end of the left-front portion 1, and a lower end of the right accessory breast receiving portion 4 is connected to an upper end of the right-front portion 2. The left-front portion 1, the right-front portion 2, the left accessory breast receiving portion 3, and the right accessory breast receiving portion 4 are connected and form a U-shaped neckline 7. Upper ends of the left accessory breast receiving portion 3, the right accessory breast receiving portion 4, and the upper back portion 5 are almost flush with one another, which helps to wrap accessory breasts at two sides and wrap the back and prevents gathering of fat on the back.

The body-shaping corset includes an edge covering 8, which is connected by seaming to outer edges of the left-front portion 1, the left accessory breast receiving portion 3, the upper back portion 5, the right accessory breast receiving portion 4, the right-front portion 2, and the lower back portion 6.

The body-shaping corset is provided therein with a plurality of air-permeable through holes 9 for air permeation, which are formed by a laser matrix and is used for reducing a muggy feeling during wearing of the body-shaping corset. The body-shaping corset further includes multiple supporting steel ribs 10, which are disposed along a longitudinal direction of the body-shaping corset.

The left-front portion 1, the right-front portion 2, the upper back portion 5, the lower back portion 6, the left accessory breast receiving portion 3, and the right accessory breast receiving portion 4 are formed integrally, which can greatly reduce the production cost.

The present disclosure is further described below.

Figure 5:
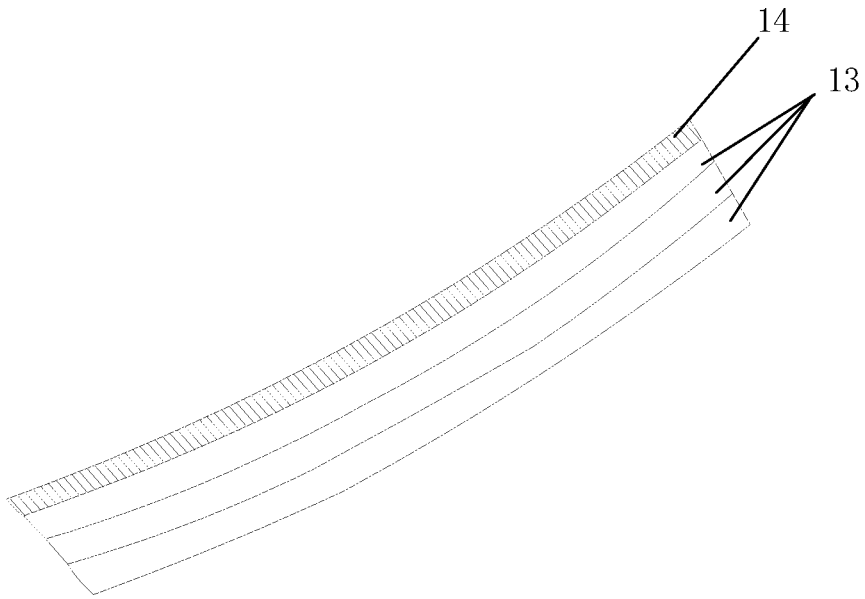
FIG. 5 is a schematic diagram of a multi-layer fabric structure and a skin-contacting layer of each portion of the body-shaping corset in the present disclosure.

The body-shaping corset in the present disclosure has an overall structure with a curved and narrowed middle section and gradually increasing upper and lower openings. The left-front portion 1, the right-front portion 2, the upper back portion 5, the lower back portion 6, the left accessory breast receiving portion 3, and the right accessory breast receiving portion 4 each have a multi-layer fabric structure 13, as shown in FIG. 5. Each layer of fabric 13 is formed from raw materials of the following parts by weight: 24-57 parts of rubber, 21-32 parts of bamboo fiber, 3.7-7 parts of graphene powder, 3.7-7 parts of tourmaline powder, 12-18.6 parts of modal fiber, and 18-30 parts of cotton. A skin-contacting layer 14 provided at an inner side of the multi-layer fabric structure 13 is made of an anti-bacterial fabric, which can effectively reduce bacteria breeding.

The body-shaping corset provided in the present disclosure has the following beneficial technical effects.

The body-shaping corset in the present disclosure has a simple structural design and low cost, is convenient to wear, and has good air permeability. The body-shaping corset has accessory breast receiving and back shaping functions, prevents fat gathering on the back which can affect body-shaping effects, and thus can meet a need of upper body shaping of females.

The above described embodiments are merely preferred embodiments of the present disclosure and are not intended for limiting the present disclosure. Modifications, equivalent substitutions, and improvements made within the spirit and principles of the present disclosure shall all fall within the protection scope of the present disclosure.

The invention claimed is:

1. A body-shaping corset, comprising: a left-front portion, a right-front portion, a left accessory breast receiving portion, a right accessory breast receiving portion, an upper back portion, and a lower back portion, wherein one side of the lower back portion is connected to one side of the left-front portion, and another side of the lower back portion is connected to one side of the right-front portion; the left-front portion is provided at one side thereof away from the lower back portion with multiple rows of loops, and the right-front portion is provided at one side thereof away from the lower back portion with hooks, the hooks and the multiple rows of loops being connected to each other by hooking; a lower end of the upper back portion is connected to an upper end of the lower back portion; one side of the upper back portion is connected to one side of the left accessory breast receiving portion, and another side of the upper back portion is connected to one side of the right accessory breast receiving portion; a lower end of the left accessory breast receiving portion is connected to an upper end of the left-front portion, and a lower end of the right accessory breast receiving portion is connected to an upper end of the right-front portion; the left-front portion, the right-front portion, the left accessory breast receiving portion, and the right accessory breast receiving portion are connected and form a U-shaped neckline.

2. The body-shaping corset according to claim 1, wherein the body-shaping corset comprises an edge covering, which is connected by seaming to outer edges of the left-front portion, the left accessory breast receiving portion, the upper back portion, the right accessory breast receiving portion, the right-front portion, and the lower back portion.

3. The body-shaping corset according to claim 1, wherein upper ends of the left accessory breast receiving portion, the right accessory breast receiving portion, and the upper back portion are flush with one another.

4. The body-shaping corset according to claim 1, wherein the body-shaping corset is provided therein with a plurality of air-permeable through holes for air permeation.

5. The body-shaping corset according to claim 1, wherein the body-shaping corset further comprises multiple supporting steel ribs, which are disposed along a longitudinal direction of the body-shaping corset.

6. The body-shaping corset according to claim 1, wherein the left-front portion, the right-front portion, the upper back portion, the lower back portion, the left accessory breast receiving portion, and the right accessory breast receiving portion are formed integrally.

* * * * *